US005373947A

United States Patent [19]

Nakamura et al.

[11] Patent Number: 5,373,947

[45] Date of Patent: Dec. 20, 1994

[54] SEPARATOR FOR REMOVING FOREIGN MATERIALS IN GRANULATED MATERIALS

[75] Inventors: Teruyuki Nakamura; Yuko Kawakami, both of Ojiya, Japan

[73] Assignee: Kyowa Kogyo Co., Ltd., Ojiya, Japan

[21] Appl. No.: 149,771

[22] Filed: Nov. 10, 1993

Related U.S. Application Data

[63] Continuation-in-part of Ser. No. 114,224, Sep. 1, 1993.

[30] Foreign Application Priority Data

Aug. 24, 1993 [JP] Japan ..... 5-47123[U]

[51] Int. Cl.[5] ..... B07C 5/36

[52] U.S. Cl. ..... 209/618; 209/669; 209/673

[58] Field of Search ..... 209/668, 618, 669, 671, 209/673, 910

[56] References Cited

U.S. PATENT DOCUMENTS

| | | | |
|---|---|---|---|
| 1,723,539 | 8/1929 | Bussard | 209/618 |
| 2,307,257 | 1/1943 | Davis | 209/673 X |
| 2,786,574 | 3/1957 | Clark | 209/669 X |
| 3,283,895 | 11/1966 | Rollins | 209/669 |
| 3,473,658 | 10/1969 | Bartlett, Jr. | 209/618 |
| 3,627,126 | 12/1971 | Fitzgerald et al. | 209/673 X |
| 4,471,876 | 9/1984 | Stevenson, Jr. et al. | 209/618 |
| 4,821,886 | 4/1989 | Roethig | 209/673 X |
| 5,024,335 | 6/1991 | Lundell | 209/669 X |
| 5,175,906 | 1/1993 | Holter | 209/618 X |

FOREIGN PATENT DOCUMENTS

| | | | |
|---|---|---|---|
| 3724240 | 2/1989 | Germany | 209/669 |
| 63-122681 | 8/1988 | Japan . | |

*Primary Examiner*—D. Glenn Dayoan

*Attorney, Agent, or Firm*—Kanesaka & Takeuchi

[57] ABSTRACT

A separator of the invention is designed to remove foreign materials, such as small stones, included in granulated materials, such as red beans, having smooth outer surfaces. The separator is formed of a supplying section, and a separating section for receiving the granulated materials with the foreign materials from the supplying section and separating the foreign materials from the granulated materials. The separating section includes at least one pair of elongated rollers formed of first and second rollers, which are arranged parallel to and at a predetermined distance spaced apart from each other. The first roller has a spiral projection on an outer surface thereof, while the second roller has a resilient outer peripheral portion. When the granulated materials with the foreign materials are supplied onto one end of the pair of the rollers, the foreign materials are caught between the rollers without being crushed and drop downwardly, while the granulated materials are transferred to the other end of the rollers by the rotating spiral projection and are collected.

6 Claims, 4 Drawing Sheets

SEPARATOR FOR REMOVING FOREIGN MATERIALS IN GRANULATED MATERIALS

CROSS REFERENCE TO RELATED APPLICATION

This is a continuation-in-part application of Ser. No. 114,224 filed on Sep. 1, 1993.

BACKGROUND OF THE INVENTION AND RELATED ART STATEMENT

The present invention relates to a separator for removing foreign materials, such as sands and small stones, contained in granulated or round materials, such as red beans, soybeans, sesame seeds, pepper corns and so on, packed in a bag.

In a packed granulated materials like red beans, foreign materials like small stones may be included. If the granulated materials are utilized or cooked as they are without removing the foreign materials, a product made by the granulated materials inevitably contains the foreign materials, which is not preferable.

For example, in case red beans are boiled and cooked for food, if foreign materials, such as small stones, are contained in packed red beans, the foreign materials may be included in the food. Thus, conventionally, when red beans are taken out of a pack, at first, the foreign materials, such as small stones, are removed by hands of a person, and after removing the foreign materials, red beans are boiled.

Removal of the foreign materials by hands is very troublesome. In order to reduce labor for this removal operation, a device disclosed in Japanese Utility Model Application No. 62-14121 was proposed.

In the device of Application No. 62-14121, for example, since red beans are transferred only by inclination of rollers, if red beans have shapes to be easily rotatable, red beans are transferred to the end of the rollers in a short period of time, so that the foreign materials removing operation can not be made sufficiently. Also, since the transfer of red beans on the rollers is made only by inclination of the rollers, the smooth transfer can not be made. Further, in case the device is stopped in a middle of the operation, red beans may still be transferred by rotation thereof due to inclination of the rollers.

In order to improve the device disclosed in Japanese Utility Model Application No. 62-14121, Japanese Utility Model Application No. 4-62170 was filed, wherein materials which do not have smooth outer surfaces are crashed between rollers and removed. Thus, in case the device is actuated, for example, red beans which do not have smooth outer surfaces or have deformed shapes are crushed by the rollers. Namely, even if red beans are usable, red beans are discarded and wasted as foreign materials.

Further, in the device disclosed in application No. 4-62170, if red beans are crushed between the rollers, oil and the broken pieces of red beans adhere to the rollers, so that friction coefficient on the rollers changes. As a result, the original function for removing foreign materials is deteriorated.

The present invention has been made to improve the drawbacks of the prior devices.

Accordingly, one object of the invention is to provide a separator for efficiently removing foreign materials from granulated materials with smooth outer surfaces.

Another object of the invention is to provide a separator as stated above, wherein irregular granulated materials are removed from regular granulated materials, and can be usable by further treatment.

A further object of the invention is to provide a separator as stated above, wherein foreign material removing function is not deteriorated for a long usage.

A still further object of the invention is to provide a separator as stated above, wherein the foreign materials can be removed regardless the size thereof and from various sizes of the granulated materials.

Further objects and advantages of the invention will be apparent from the following description of the invention.

SUMMARY OF THE INVENTION

In accordance with the present invention, a separator is designed to remove foreign materials, such as small stones, included in granulated or round materials, such as red beans, having smooth outer surfaces. The separator is basically formed of a supplying section for providing the granulated materials with the foreign materials, and a separating section for receiving the granulated materials with the foreign materials and separating the foreign materials from the granulated materials.

The separating section includes at least one pair of elongated rollers formed of first and second rollers, which are arranged parallel to and at a predetermined distance spaced apart from each other, and means for rotating the rollers in opposite directions. The first roller has a spiral projection on an outer surface thereof, and the second roller has a resilient peripheral portion.

When the granulated materials with the foreign materials are supplied on one side or end of the pair of the rollers, the foreign materials are caught between the rollers and dropped downwardly, while the granulated materials are held between the rollers and are transferred to the other side or end of the rollers by the rotating spiral projection. Thus, the foreign materials are completely removed from the granulated materials.

In the invention, the first roller with the spiral projection is made of a solid material, such as metal, while the second roller has a resilient outer peripheral portion with a frictional surface. Thus, when the foreign material is caught between the two rollers, the foreign material passes between the rollers and drops downwardly. The foreign material is not crushed by the rollers.

Thus, even if the granulated material is caught by the rollers, the granulated material is not crushed and can be recovered later. Also, since the granulated material is not crushed, oil of the granulated material does not adhere to the rollers, so that the crushed granulated material does not deteriorate the rollers.

The pair of rollers may have a wide space portion at the other end of the rollers. The granulated materials supported on the pair of rollers and transferred by the spiral projection to the other end fall down through the wide space portion.

The height of the spiral projection and the distance between the two rollers are adjusted based on the size of the granulated material to be processed.

DETAILED DESCRIPTION OF A PREFERRED EMBODIMENT

Figure 1:
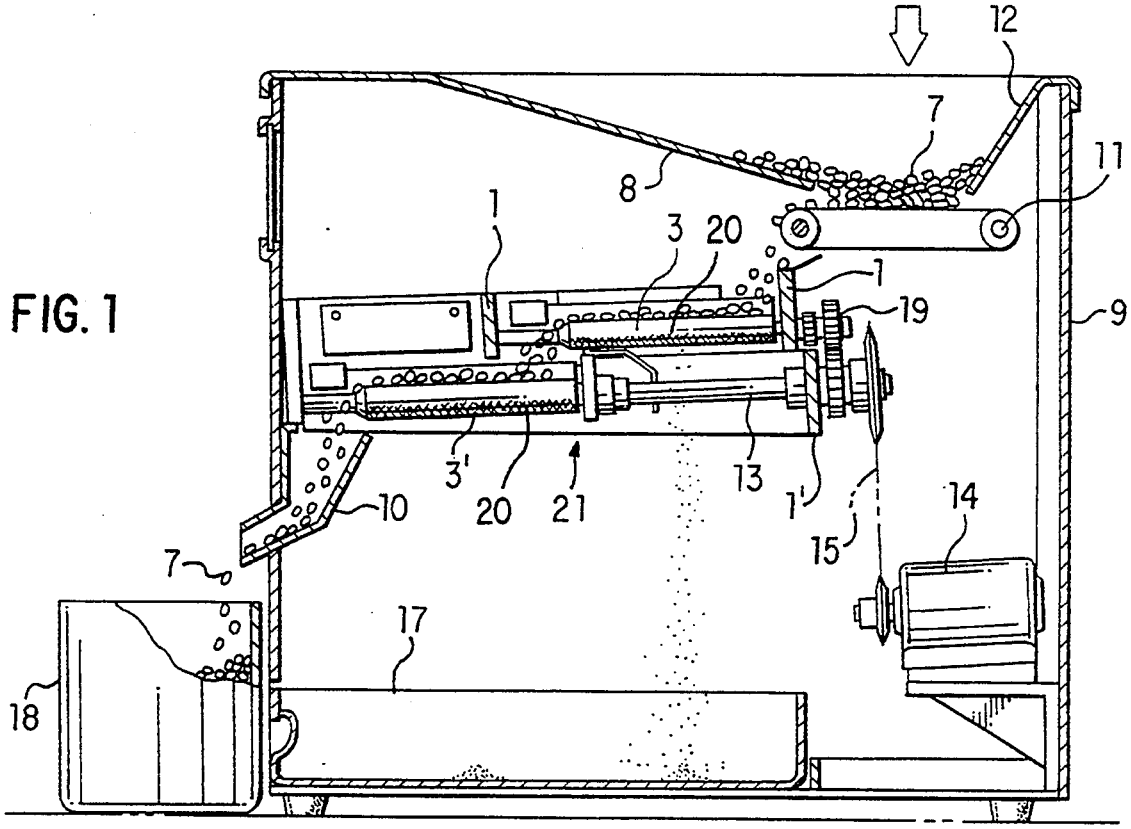
FIG. 1 is a side section view for showing a separator of the invention.
Figure 2:
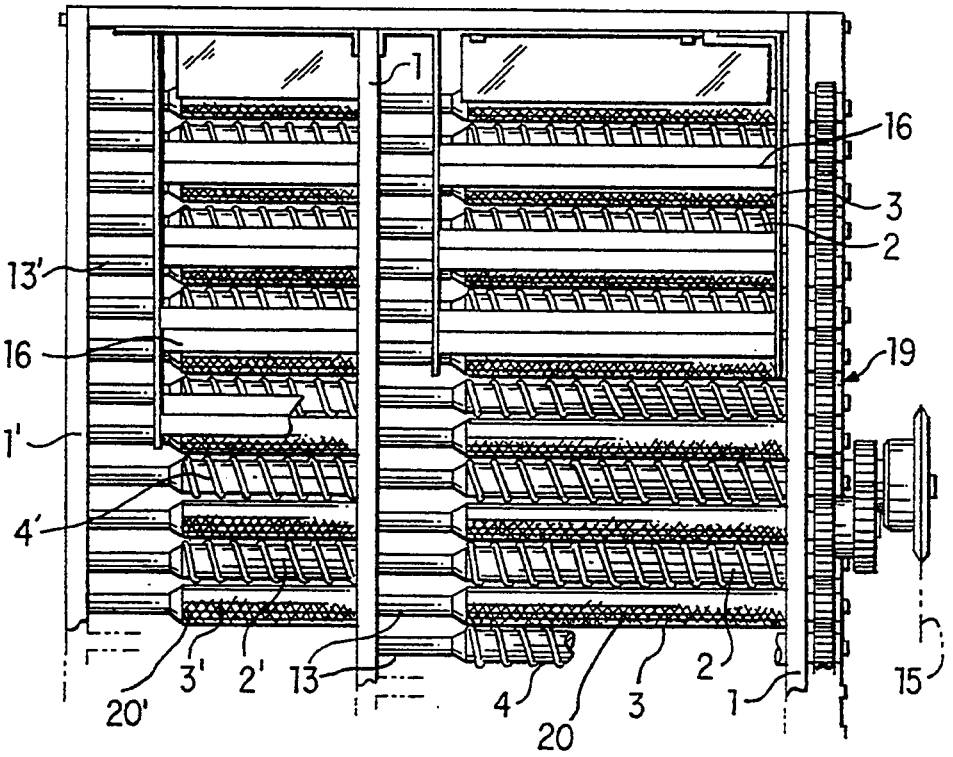
FIG. 2 is an explanatory plan view of a part of the separator of the invention.
Figure 3:
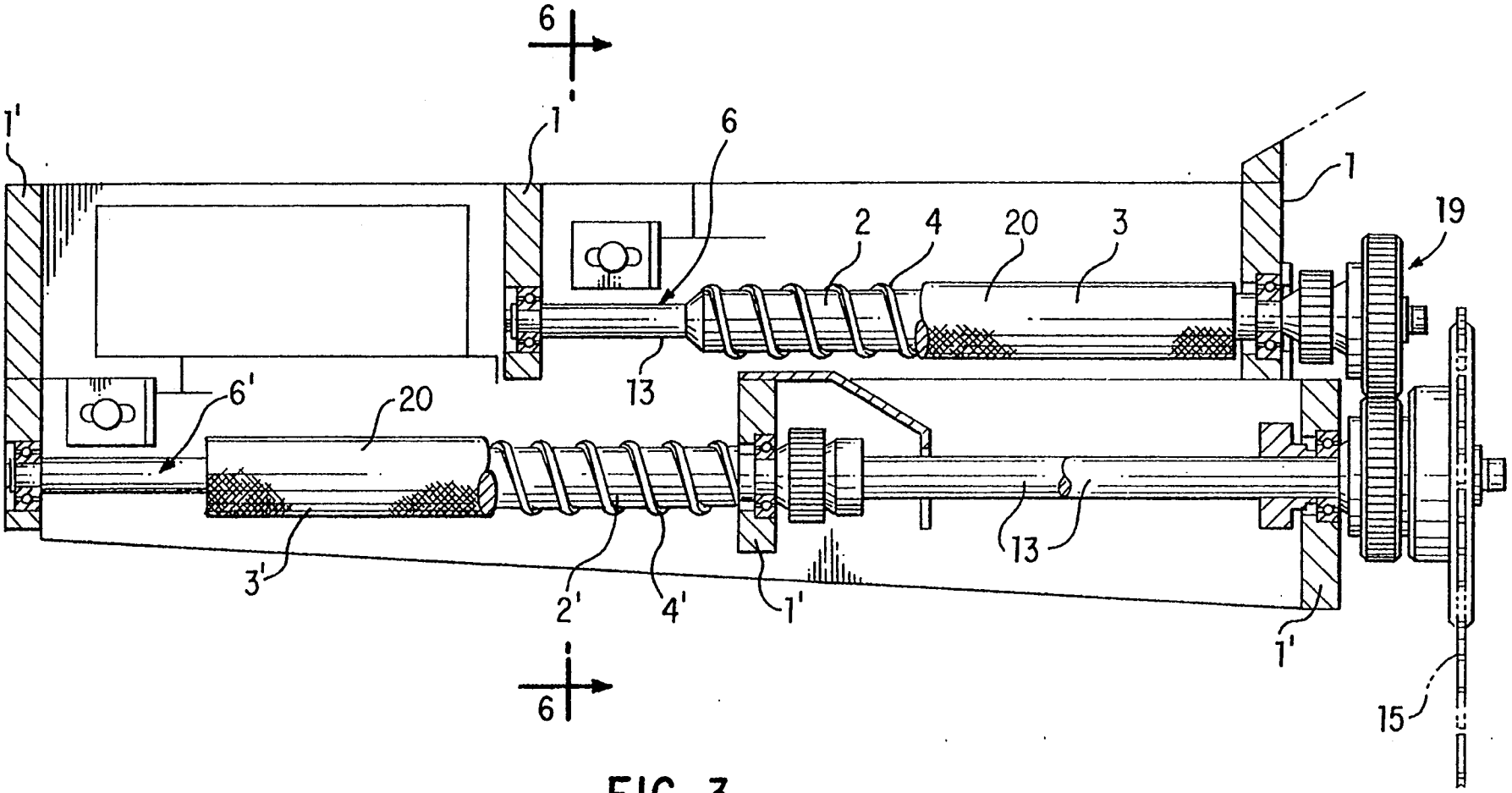
FIG. 3 is an enlarged side view of a part of the separator of the invention.

As shown in FIG. 1, a separator of the invention includes a housing 9, a material supply portion 8 for receiving granulated materials or red beans 7 with foreign materials, such as small stones and sands, a separating portion 21, and a material outlet portion 10 for ejecting only the granulated materials 7. The foreign materials are removed at the separating portion 21.

The material supply portion 8 is located at the upper part of the housing 9, and is formed of a hopper 12 and a conveyer 11 situated under the hopper 12. The granulated materials 7 with the foreign materials supplied to the hopper 12 are transferred to the separating portion 21 by the conveyer 11.

The separating portion 21 includes support plates 1, 1' attached to the housing 9. A plurality of pairs of upper rollers 2, 3 is rotationally supported between the two support plates 1, and a plurality of pairs of lower rollers 2', 3' is located under the upper rollers 2, 3 and supported by the support plates 1'. The rollers 2, 3, 2', 3' are slightly inclined toward the outlet portion 10.

The roller 2 has a spiral projection 4 on an outer surface thereof. The height of the projection 4 from the outer surface of the roller 2 is less than the size or smallest length of the granulated material 7 to be processed. Also, the height of the projection 4 is determined with reference to the inclination of the rollers 2, 3, such that the granulated materials 7 situated on the rollers 2, 3 do not roll beyond the projection 4.

The outer surface of the roller 2 except for the projection 4 is made smooth. The roller 2 is made of a hard material, such as metal.

Figure 4:
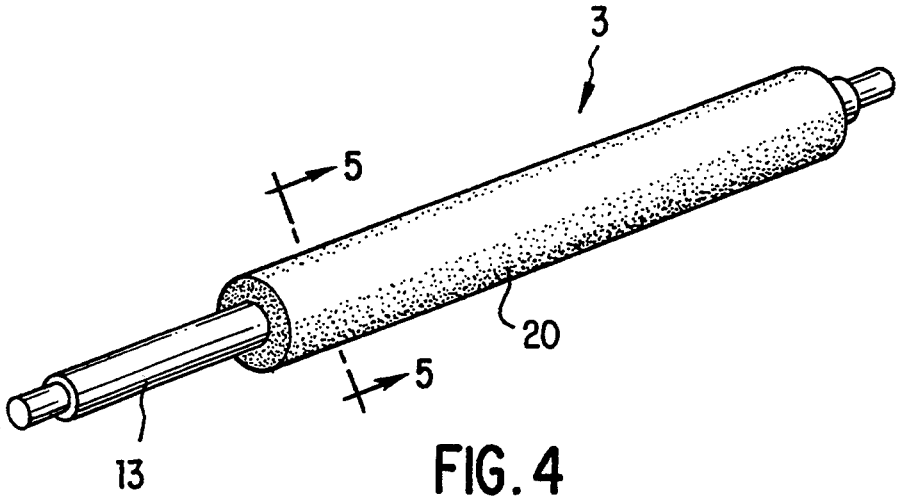
FIG. 4 is a perspective view of a resilient roller.
Figure 5:
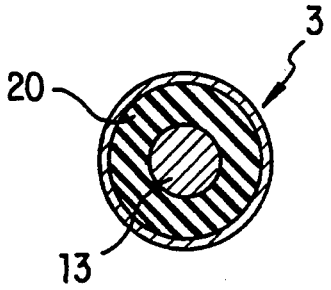
FIG. 5 is a section view taken along a line 5—5 in FIG. 4.
Figure 6:
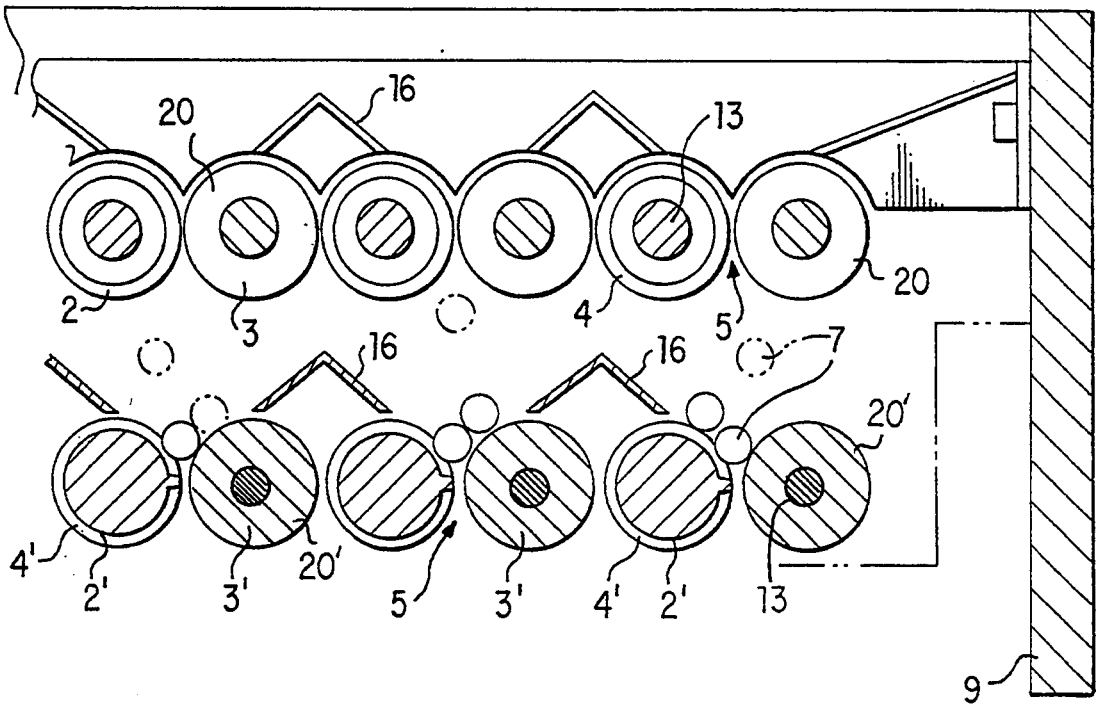
FIG. 6 is a section view taken along a line 6—6 in FIG. 3.

As shown in FIGS. 4 and 5, the roller 3 is formed of an axis or a shaft 13, and a resilient material 20, such as a sponge disposed on the shaft 13. The outer surface of the resilient material 20 is covered with a friction material. For example, sands with diameter of 3–5 micrometers or fibers may be fixed on the outer surface of the resilient material 20 by an adhesive.

If the friction on the roller 3 is too much, the granulated materials 7 are easily caught between the rollers 2, 3. Thus, the friction on the roller 3 is determined with reference the friction of the granulated materials 7. The roller 2 may have a frictional surface.

The distance 5 between the rollers 2, 3 is determined based on the size of the granulated materials to be processed. Namely, in case the granulated material has a large size, the distance 5 between the rollers 2, 3 is spaced apart largely. On the other hand, in case the granulated material has a small size, the distance 5 between the rollers 2, 3 is made small. Namely, the distance 5 is determined such that the granulated materials 7 are not caught between the two rollers 2, 3.

The rollers 2, 3 have long axes 13 at side portions located away from the conveyer 11 to form a space 6 therebetween. The space 6 is greater than the size of the granulated material 7. Thus, the granulated materials 7 transferred by the rollers 2, 3 drop downwardly through the space 6.

The rollers 2, 3 include gears 19 at side portions opposite to the space 6. The gears 19 are connected to each other, and are in turn connected to a motor 14 through a belt 15. When the motor 14 is actuated, the rollers 2, 3 are rotated in the opposite directions to receive or pull the granulated materials between the rollers 2, 3.

The pairs of the rollers 2, 3 are arranged side by side so that the granulated materials are processed by a plurality of the pairs of the rollers 2, 3. A guide plate 16 is located between the rollers 2, 3 which do not constitute the pair. Thus, the granulated materials are properly supplied to the respective pairs of the rollers 2, 3.

Under the pairs of rollers 2, 3, pairs of rollers 2', 3' are arranged so that the granulated materials processed by the rollers 2, 3 are again supplied to the pairs of the rollers 2', 3'.

The rollers 2', 3' are almost the same as the rollers 2, 3. Namely, the roller 2' has a projection 4', and the roller 3' has a sponge 20' with a frictional outer surface. Also, a space 6' is formed between the rollers 2', 3'.

However, the rollers 2', 3'have shafts 13' with gears, which engage the gears 19. Thus, when the motor 14 is actuated, the rollers 2', 3' are rotated together with the rollers 2, 3.

In the housing 9, a tray 17 for receiving the removed foreign materials is disposed. Also, a box 18 is located outside of the housing 9 to receive the granulated materials 7 from the outlet 10.

In the invention, when red beans 7 with small stones are supplied into the hopper 12, the red beans 7 with the small stones are transferred by the conveyer 11 and are supplied onto the pairs of the rollers 2, 3. As the rollers 2, 3 are rotated, the red beans 7 are not caught by the rollers 2, 3 and are gradually transferred by the projections 4 to the space 6, while the small stones are caught by the rollers 2, 3 and fall down to the tray 17.

Since the stones have friction greater than the red beans, even if the stones are greater than the space between the rollers 2, 3, the stones are caught between the rollers 2, 3. The stone caught by the rollers 2, 3 are not crushed between the rollers 2, 3, because the roller 3 has the sponge 20 outside.

The packed red beans contain mostly regular or uniform size with smooth outer surfaces, but the red beans contain small amount of irregular size with deformed shape. In the invention, the red beans with the irregular size are caught by the rollers 2, 3, and drop downwardly without being crushed. Thus, the irregular size red beans may be recovered to fully utilize the materials. Also, since the irregular red beans are not crushed, oil and small pieces of the red beans do not adhere to the rollers 2, 3. Thus, the rollers 2, 3 is not deteriorated.

In this respect, if the red beans are crushed, oil and small pieces adhere to the rollers 2, 3, so that friction of the rollers 2, 3 changes. As a result, the intended operation can not be performed.

Now, the red beans transferred to the ends of the rollers 2, 3 fall down to the rollers 2', 3' through the spaces 6. The red beans 7 on the rollers 2', 3' are processed again and the stones still left in the red beans 7 are removed. The red beans falling down through the spaces 6' are collected at the outlet 10 and are supplied to the box 18.

In the invention, small stones and sands are substantially completely removed from the granulated materials 7.

In the invention, the spiral projections 4, 4' are formed around the rollers 2, 2'. The projections 4, 4' operate to keep the granulated materials on the rollers for a sufficient period of time so that the foreign materials are caught between the rollers. If there is no projection, the granulated materials between the two rollers roll down quickly along the rollers, and the foreign materials can not be removed sufficiently.

In the present invention, the rollers 2, 3, 2', 3' are set in two stages. If the rollers 2, 3 are only formed, in case the granulated materials together with foreign materials stick together, the stuck materials may not sufficiently separate from each other by the rollers 2, 3. However, the stuck materials can be separated when the stuck materials fall down to the rollers 2', 3' through the space 6. Thus, the foreign materials can be substantially completely removed from the granulated materials.

Further, in the present invention, in case the shapes of the granulated materials supplied to the hopper are not uniform, while the granulated materials are processed by the rollers, different shapes of the granulated materials are removed. Thus, substantially equal shapes of the granulated materials are obtained at the outlet. Also, since the removed granulated materials are collected without being crushed, the granulated material may be fully utilized after removing the stone.

While the invention has been explained with reference to the specific embodiment of the invention, the explanation is illustrative and the invention is limited only by the appended claims.

What is claimed is:

1. A separator for removing foreign materials from granulated materials, comprising:

a supplying section for providing the granulated materials with the foreign materials, and a separating section for receiving the granulated materials with the foreign materials from the supplying section and separating the foreign materials from the granulated materials, said separating section including at least one pair of rollers formed of first and second rollers arranged parallel to and at a predetermined distance spaced apart from each other, another pair of said rollers disposed under said pair of rollers to partly overlap with each other, and means for rotating the rollers in opposite directions, said first roller having a spiral projection on an outer surface thereof and said second roller having a resilient peripheral portion with a frictional surface so that when the granulated materials with the foreign materials are supplied onto one end of the pair of the rollers, the foreign materials are easily caught between and drop from the rollers without being crushed by the rollers and the granulated materials are transferred to the other end of the rollers, said each pair of rollers having a wide space portion at said other end of the rollers, said granulated materials disposed on the pair of the rollers and transferred by the spiral projection to said other end being ejected through the wide space portion so that the foreign materials are removed from the granulated materials by the two pairs of the rollers.

2. A separator according to claim 1, wherein height of the spiral projection is lower than a size of the granulated material.

3. A separator according to claim 1, wherein said pairs of the rollers are arranged side by side, respectively.

4. A separator according to claim 3, further comprising a plurality of guide plates situated between two adjacent pairs of rollers so that the granulated materials with the foreign materials are supplied between the first and second rollers.

5. A separator according to claim 3, wherein said supplying section includes a hopper and a conveyer to supply the granulated materials with the foreign materials from the hopper to the rollers.

6. A separator according to claim 1, wherein said granulated material has a smooth outer surface so that frictional coefficient of the granulated material is less than that of the foreign material.

* * * * *

UNITED STATES PATENT AND TRADEMARK OFFICE

CERTIFICATE OF CORRECTION

PATENT NO. : 5,373,947

DATED : December 20, 1994

INVENTOR(S) : Teruyuki Nakamura et al

It is certified that error appears in the above-identified patent and that said Letters Patent is hereby corrected as shown below:

The Cover Page, Foreign Application Priority Data Section, change Priority Document Number "5-47123(U)" to --5-46123(U)--.

Signed and Sealed this

Eleventh Day of April, 1995

*Attest:*

Bruce Lehman

BRUCE LEHMAN

*Attesting Officer*

*Commissioner of Patents and Trademarks*